US010873138B2

(12) United States Patent
Perumana et al.

(10) Patent No.: US 10,873,138 B2
(45) Date of Patent: Dec. 22, 2020

(54) CYCLIC STAGGERED COMMUNICATIONS NETWORK WITH SWITCHED ANTENNA POLARIZATION DIVERSITY

(71) Applicant: Avago Technologies International Sales PTE. Limited, Singapore (SG)

(72) Inventors: Bevin George Perumana, Manteca, CA (US); Seunghwan Yoon, Irvine, CA (US); Bagher Afshar, Irvine, CA (US); Saikat Sarkar, Irvine, CA (US); Ehsan Adabi Firouzjaei, Newport Beach, CA (US); Michael John Inglis Boers, South Turramurra (AU); Jesus Alfonso Castaneda, Los Angeles, CA (US); Tirdad Sowlati, Irvine, CA (US)

(73) Assignee: Avago Technologies International Sales Pte. Limited, Singapore (SG)

( * ) Notice: Subject to any disclaimer, the term of this patent is extended or adjusted under 35 U.S.C. 154(b) by 255 days.

(21) Appl. No.: 15/962,631

(22) Filed: Apr. 25, 2018

(65) Prior Publication Data

US 2018/0241137 A1 Aug. 23, 2018

Related U.S. Application Data

(62) Division of application No. 14/105,406, filed on Dec. 13, 2013, now Pat. No. 9,985,357.

(60) Provisional application No. 61/899,392, filed on Nov. 4, 2013.

(51) Int. Cl.

| | |
|---|---|
| ***H01Q 21/30*** | (2006.01) |
| ***H01Q 3/24*** | (2006.01) |
| ***H01Q 21/20*** | (2006.01) |

(52) U.S. Cl.

CPC ..... *H01Q 21/30* (2013.01); *H01Q 3/24* (2013.01); *H01Q 21/20* (2013.01)

(58) Field of Classification Search

CPC ..... H01Q 21/20; H01Q 21/205; H01Q 21/30; H01Q 3/24

See application file for complete search history.

(56) References Cited

U.S. PATENT DOCUMENTS

| | | | | |
|---|---|---|---|---|
| 5,027,125 | A | 6/1991 | Tang | |
| 2007/0222701 | A1* | 9/2007 | Yoon | H01Q 1/2216 343/895 |
| 2011/0249770 | A1 | 10/2011 | Bellaouar et al. | |
| 2011/0274146 | A1 | 11/2011 | Huang et al. | |
| 2013/0072125 | A1 | 3/2013 | Yoon et al. | |
| 2013/0169505 | A1 | 7/2013 | Shmuel | |

* cited by examiner

*Primary Examiner* — Daniel Munoz

(74) *Attorney, Agent, or Firm* — Foley & Lardner LLP

(57) ABSTRACT

A system and apparatus is provided to reduce signal routing, area and signal loss in double-pole, double-throw (DPDT) switch implementations in wireless and millimeter-wave front ends. A cyclic staggered arrangement of receivers, transmitters and antenna ports connecting with DPDT switches reduce signal cross-over and allow for compact, low-loss multi-antenna configurations.

20 Claims, 9 Drawing Sheets

CYCLIC STAGGERED COMMUNICATIONS NETWORK WITH SWITCHED ANTENNA POLARIZATION DIVERSITY

CROSS REFERENCE TO RELATED PATENT/PATENT APPLICATIONS INCORPORATION BY REFERENCE

The present U.S. Utility Patent Application claims priority pursuant to 35 U.S.C. § 121 as a divisional of U.S. Utility application Ser. No. 14/105,406, entitled "Staggered Network Based Transmit/Receive Switch with Antenna Polarization Diversity," filed Dec. 13, 2013, which claims priority pursuant to 35 U.S.C. § 119(e) to U.S. Provisional Application No. 61/899,392, entitled "Staggered Network Based Transmit/Receive Switch with Antenna Polarization Diversity," filed Nov. 4, 2013, both of which are hereby incorporated herein by reference in their entirety and made part of the present U.S. Utility Patent Application for all purposes.

BACKGROUND

Technical Field

The present disclosure described herein relates generally to wireless communications and more particularly to multi-antenna configurations in a wireless communication device.

Description of Related Art

Communication systems are known to support wireless and wireline communications between wireless and/or wireline communication devices. Such communication systems range from national and/or international cellular telephone systems to the Internet to point-to-point in-home wireless networks to radio frequency identification (RFID) systems. Each type of communication system is constructed, and hence operates, in accordance with one or more communication standards. For instance, wireless communication systems may operate in accordance with one or more standards including, but not limited to, 3GPP (3rd Generation Partnership Project), 4GPP (4th Generation Partnership Project), LTE (long term evolution), LTE Advanced, RFID, IEEE 802.11, Bluetooth, AMPS (advanced mobile phone services), digital AMPS, GSM (global system for mobile communications), CDMA (code division multiple access), LMDS (local multi-point distribution systems), MMDS (multi-channel-multi-point distribution systems), and/or variations thereof.

Depending on the type of wireless communication system, a wireless communication device, such as a cellular telephone, smartphone, two-way radio, tablet, personal digital assistant (PDA), personal computer (PC), laptop computer, home entertainment equipment, RFID reader, RFID tag, et cetera communicates directly or indirectly with other wireless communication devices. For each wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the transceiver is coupled to one or more antennas, for example, multiple-input, multiple-output (MIMO) and may include one or more low noise amplifiers, one or more intermediate frequency stages, a filtering stage, and a data recovery stage.

As is also known, diversity antenna structures include two or more antennas that are spaced at one-quarter wavelength intervals. Each antenna receives the same RF signals and the received signal strength of each antenna is measured. The antenna having the strongest, or most consistently strong, signal strength is selected as the RF input for the receiver. This can be a dynamic process that changes as the receiver is moved.

BRIEF DESCRIPTION OF THE DRAWING(S)

DETAILED DESCRIPTION

Figure 1:
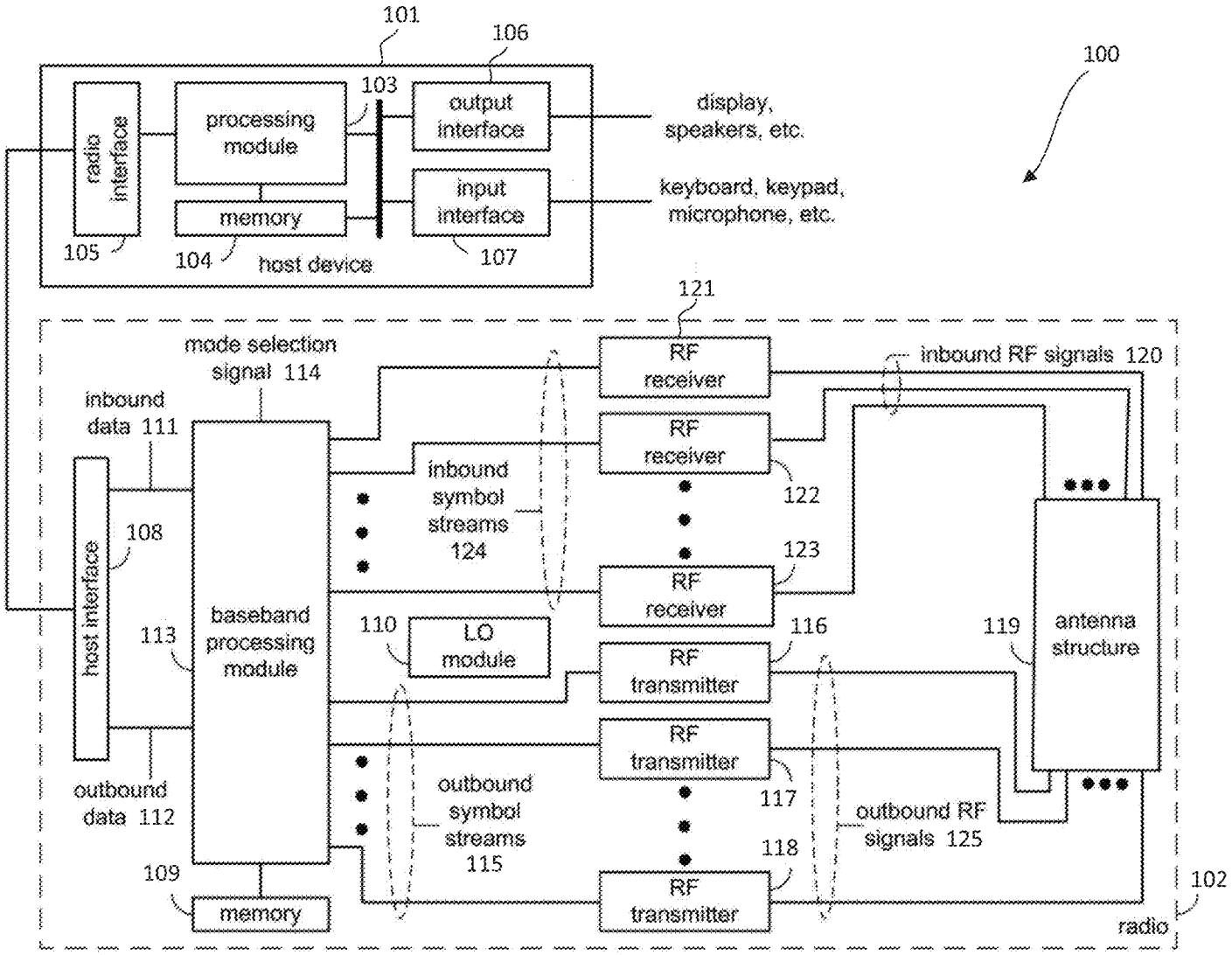
FIG. 1 illustrates an example schematic block diagram of a wireless communication device in accordance with the present disclosure.

FIG. 1 illustrates an example schematic block diagram of a wireless communication device 100 in accordance with the present disclosure. For cellular telephone hosts, the radio 102 is a built-in component. For personal digital assistants hosts, laptop hosts, and/or personal computer hosts, the radio 102 may be built-in or an externally coupled component.

As illustrated, host device 101 includes processing module 103, memory 104, radio interface 105, input interface 107 and output interface 106. The processing module 103 and memory 104 execute instructions typically performed by the host device. For example, for a cellular telephone host device, the processing module 103 performs the corresponding communication functions in accordance with a particular cellular telephone standard.

Radio interface 105 allows data to be received from and sent to radio 102. For data received from radio 102 (e.g., inbound data), radio interface 105 provides data to processing module 103 for further processing and/or routing to output interface 106. Output interface 106 provides connectivity to an output display device such as a display, monitor, speakers, et cetera such that the received data may be displayed. Radio interface 105 also provides data from processing module 103 to radio 102. Processing module 103 may receive outbound data from an input device such as a keyboard, keypad, microphone, et cetera via input interface 107 or generate the data itself. For data received via input interface 107, the processing module 103 may perform a corresponding host function on the data and/or route it to the radio 102 via radio interface 105.

Radio 102 includes a host interface 108, memory 109, a receiver path, a transmit path, a local oscillation module 110, and an antenna structure 119, which may be on-chip, off-chip, or a combination thereof. The receive path includes a baseband processing module 113 and a plurality of RF receivers 121-123. The transmit path includes baseband processing module 113 and a plurality of radio frequency (RF) transmitters 116-118. Baseband processing module 113, in combination with operational instructions stored in memory 109 and/or internally operational instructions, executes digital receiver functions and digital transmitter functions, respectively. The digital receiver functions include, but are not limited to, digital intermediate frequency to baseband conversion, demodulation, constellation demapping, depuncturing, decoding, de-interleaving, fast Fourier transform, cyclic prefix removal, space and time decoding, and/or descrambling. The digital transmitter functions include, but are not limited to, scrambling, encoding, puncturing, interleaving, constellation mapping, modulation, inverse fast Fourier transform, cyclic prefix addition, space and time encoding, and digital baseband to IF conversion. Processing module 103 and/or baseband processing module 113 may be implemented using one or more processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions. Memory 109 may be a single memory device or a plurality of memory devices. Such a memory device may be a read-only memory, random access memory, volatile memory, non-volatile memory, static memory, dynamic memory, flash memory, and/or any device that stores digital information. Note that when processing module 103 and/or baseband processing module 113 implements one or more of its functions via a state machine, analog circuitry, digital circuitry, and/or logic circuitry, the memory storing the corresponding operational instructions is embedded with the circuitry comprising the state machine, analog circuitry, digital circuitry, and/or logic circuitry.

In operation, radio 102 receives outbound data 112 from host device 101 via host interface 108. Baseband processing module 113 receives outbound data 112 and, based on a mode selection signal 114, produces one or more outbound symbol streams 115. Mode selection signal 114 will indicate a particular mode of operation that is compliant with one or more specific modes of the various IEEE 802.11, 3G, 4G, LTE, RFID, etc., standards. For example, the mode selection signal 114 may indicate a frequency band of 2.4 GHz, a channel bandwidth of 20 or 22 MHz and a maximum bit rate of 54 megabits-per-second. In this general category, the mode selection signal will further indicate a particular rate ranging from 1 megabit-per-second to 54 megabits-per-second. In addition, the mode selection signal will indicate a particular type of modulation, which includes, but is not limited to, Barker Code Modulation, BPSK, QPSK, CCK, 16 QAM and/or 64 QAM. Mode selection signal 114 may also include a code rate, a number of coded bits per subcarrier (NBPSC), coded bits per OFDM symbol (NCBPS), and/or data bits per OFDM symbol (NDBPS). Mode selection signal 114 may also indicate a particular channelization for the corresponding mode that provides a channel number and corresponding center frequency. Mode selection signal 114 may further indicate a power spectral density mask value and a number of antennas to be initially used for a MIMO communication.

Baseband processing module 113, based on the mode selection signal 114 produces one or more outbound symbol streams 115 from outbound data 112. For example, if the mode selection signal 114 indicates that a single transmit antenna is being utilized for the particular mode that has been selected, the baseband processing module 113 will produce a single outbound symbol stream (one of outbound symbol streams 115). Alternatively, if the mode selection signal 114 indicates 2, 3 or 4 antennas, the baseband processing module 113 will produce 2, 3 or 4 outbound symbol streams 115 from the outbound data 112.

Depending on the number of outbound symbol streams 115 produced by the baseband processing module 113, a corresponding number of the RF transmitters 116-118 will be enabled to convert the outbound symbol streams 115 into outbound RF signals 125. The RF transmitters 116-118 provide the outbound RF signals 125 to a corresponding antenna of the antenna structure 119.

When radio 102 is in the receive mode, the antenna structure 119 receives one or more inbound RF signals 120 and provides them to one or more RF receivers 121-123. The RF receivers 121-123 convert the one or more inbound RF signals 120 into a corresponding number of inbound symbol streams 124. The number of inbound symbol streams 124 will correspond to the particular mode in which the data was received. The baseband processing module 113 converts the inbound symbol streams 124 into inbound data 111, which is provided to the host device 101 via the host interface 108.

The wireless communication device 100 of FIG. 1 may be implemented using one or more integrated circuits. For example, the host device 101 may be implemented on one integrated circuit, the baseband processing module 113 and memory 109 may be implemented on a second integrated circuit, and the remaining components of the radio 102, may be implemented on a third integrated circuit. As an alternate example, the radio 102 may be implemented on a single integrated circuit. As yet another example, the processing module 103 of the host device 101 and the baseband processing module 113 may be a common processing device implemented on a single integrated circuit. Further, the memory 104 and memory 109 may be implemented on a single integrated circuit and/or on the same integrated circuit as the common processing modules of processing module 103 and the baseband processing module 113.

Antenna structure 119, in one or more embodiments, includes multiple antenna designs (e.g., MIMO) for both transmission and reception. While the number of antennas used to transmit/receive may be variable, the directionality (direction to receive or transmit signals) may also vary. To affect directionality, antennas may be polarized. In RF communications, polarization is a property of waves that can oscillate with more than one orientation.

Figure 2:
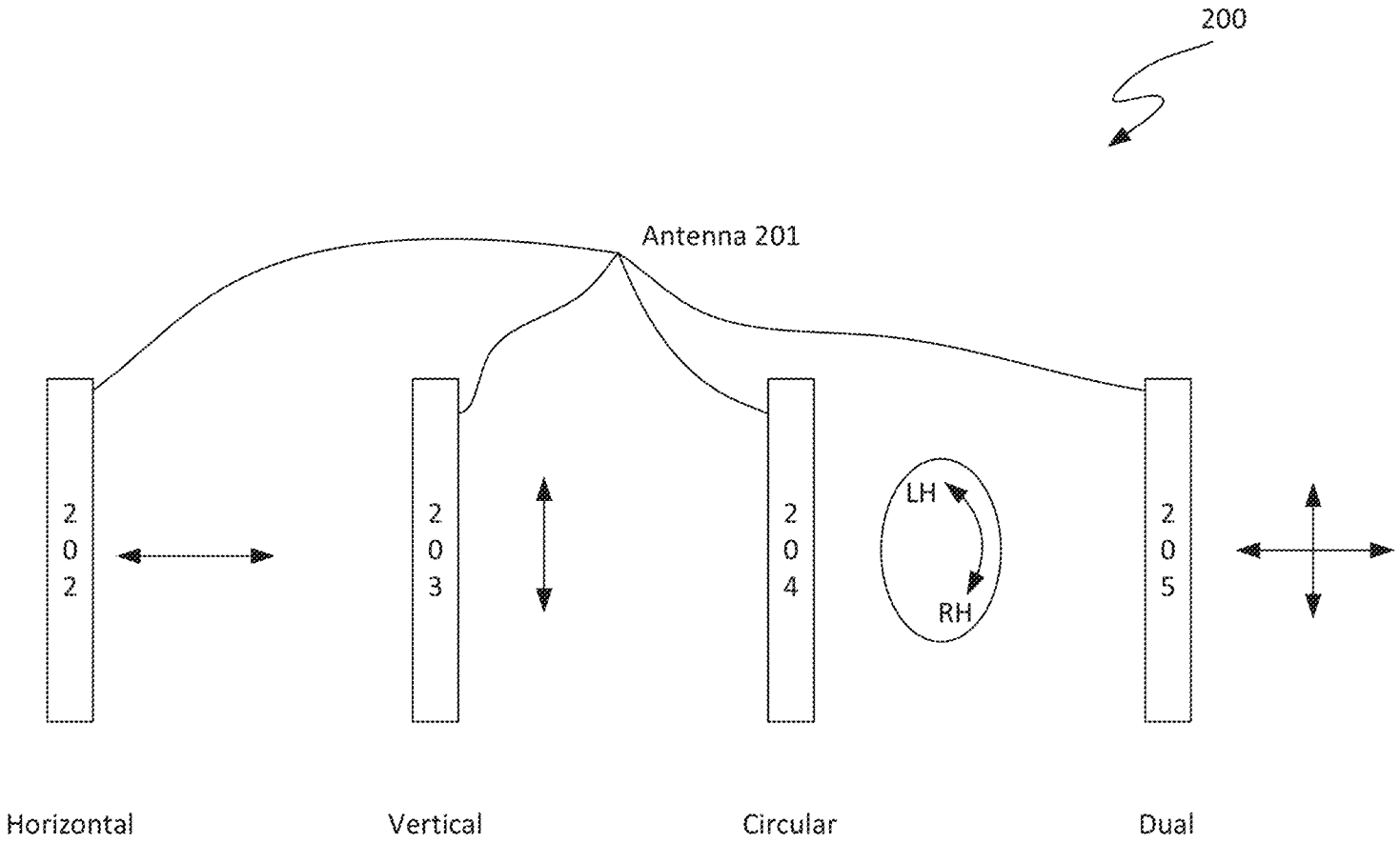
FIG. 2 illustrates an example diagram of antenna polarizations for a communications device in accordance with the present disclosure.

FIG. 2 illustrates an example diagram of antenna polarizations for a communications device in accordance with the present disclosure. A variety of antenna polarizations 200 are shown for antennas 201. There are basically three common antenna polarizations: horizontal 202, vertical 203 and circular 204. In horizontal polarization, the signal moves in a horizontal fashion (-). In vertical polarization, the signal moves in a vertical fashion (|). In circular polarization, the signal moves in a circular fashion (O) with either left-handed (LH) or right-handed (RH) rotation. Embodiments described in accordance with the present disclosure are not limited to a specific polarization.

To increase reception/transmission, matching an angle of, for example, of a specific oriented received signal will provide a stronger signal. However, cross-polarization of signals between the transmitter and the receiver limit the received signal power in wireless communications links with a limited number of signal pathways between the transmitter and receiver. Cross-polarization is radiation orthogonal to the desired polarization. For instance, the cross-polarization of a vertically polarized antenna is the horizontally polarized fields.

FIG. 2 also illustrates a dual-polarized (horizontal and vertical) antenna configuration 205. Dual-polarized antennas are typically used to avoid cross-polarization by implementing double-pole, double-throw (DPDT) switches to connect the dual-polarized antenna elements to the transmitter and receiver at each end of the communication link. However, any signal loss in DPDT switches directly reduces transmitted output power and increases receiving noise, thus degrading the communications link.

Figure 3:
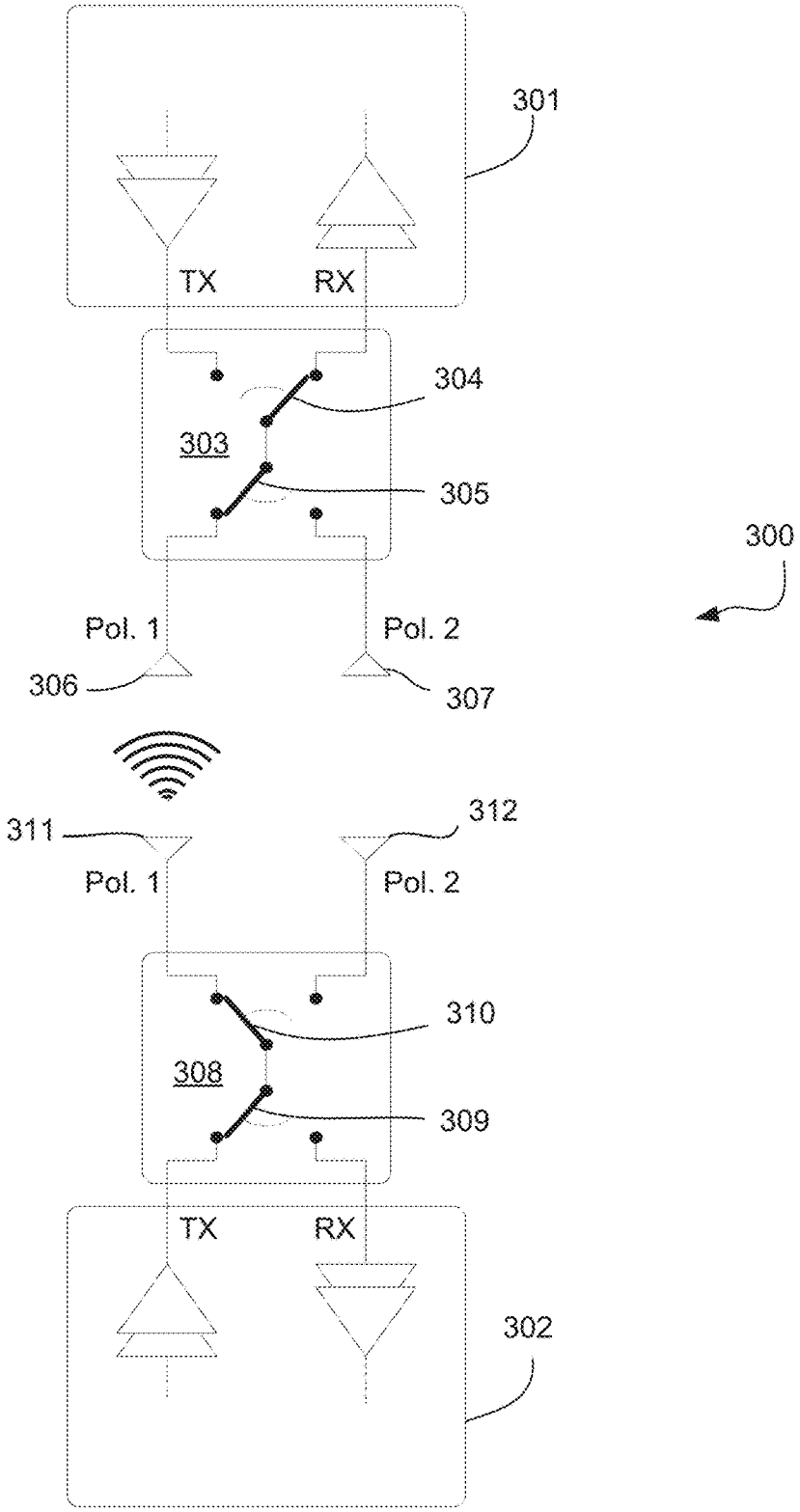
FIG. 3 illustrates a DPDT switch design for a dual-polarized transceiver communications link in accordance with the present disclosure.

FIG. 3 illustrates a DPDT switch design for a dual-polarized transceiver communications link in accordance with the present disclosure. Communications circuitry 300 includes a communications link for communication between two transceivers. Transceivers 301 and 302 (each having one or more transmitters paired to one or more receivers) include a transmission (Tx) pathway and a reception (Rx) pathway. Transceiver 301 is shown in Rx mode where DPDT switch 303 is in an Rx position. To operate in Rx mode, the DPDT switch has Tx/Rx selection switch (operating mode) 304 in a Rx position and antenna polarization selection switch 305 in position to select Pol. 1 polarized antenna 306. As previously discussed, various polarizations (pol.) can be implemented without departing from the scope of the technology described herein. In one embodiment, Pol. 1 polarized antenna 306 is a higher priority antenna (e.g., stronger reception). Transceiver 302 is shown in Tx mode where DPDT switch 308 has Tx/Rx selection switch 309 in the Tx position and antenna polarization selection switch 310 in position to select matching Pol. 1 polarized antenna 311. Pol. 2 polarized antennas 307 and 312 are not selected for operation, however, the communications link as provided is operable using either polarized antennas (Pol. 1 or Pol. 2).

Figure 4A:
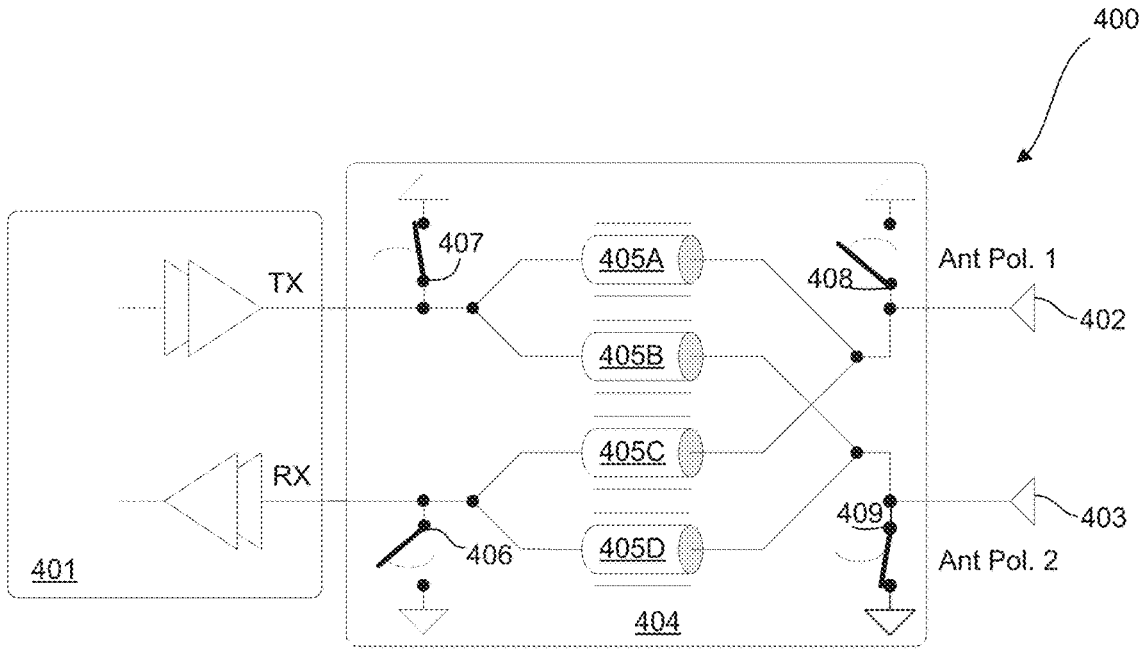
FIGS. 4A and 4B illustrate aspect embodiments of standard DPDT switch designs for a dual-polarized transceiver communications link using quarter wavelength transmission lines and switches in accordance with the present disclosure.

FIG. 4A illustrates an aspect embodiment of a DPDT switch design for a dual-polarized transceiver communications link using quarter wavelength transmission lines and switches in accordance with the present disclosure. Communications circuitry 400 includes a transceiver that is connected to multiple antennas ports through a DPDT switch using quarter wavelength transmission lines. A transmission line is a specialized cable (or other structure) designed to carry alternating current of a radiofrequency current between the antenna(s) and transceiver. A quarter-wave transmission line is a component of a length of transmission line or waveguide exactly one-quarter of a wavelength (λ) long and terminated in some known impedance.

Transceiver 401 includes a Tx pathway and an Rx pathway that are connected to (paired) polarized antennas 402 (Pol. 1) and 403 (Pol. 2) through DPDT switch 404. DPDT switch 404 includes 4 quarter wavelength transmission lines 405A, 405B, 405C and 405D (i.e., 2 for each pathway). In the Rx pathway (shown as activated), RF signals are received by either Pol. 1 antenna 402 or Pol. 2 antenna 403 based on the position of switches 406, 407, 408 and 409. For the RF signal to be received through Pol. 1 antenna 402 switch 406 is open and switch 408 is open allowing the RF signal to be received through quarter wavelength transmission line 405C. However, the DPDT configuration as provided includes a large area and contains signal cross-overs that increase signal loss and reduce isolation between antenna ports.

Figure 4B:
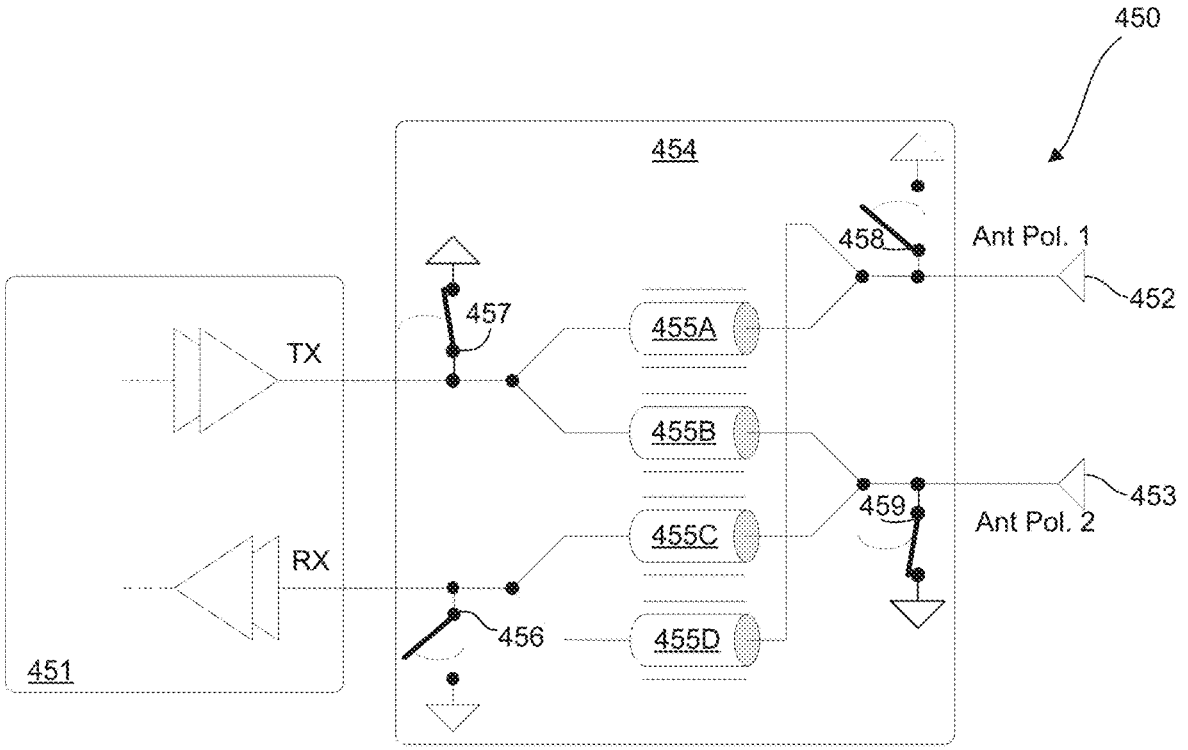

FIG. 4B illustrates another aspect embodiment of a DPDT switch design for a dual-polarized transceiver communications link using quarter wavelength transmission lines and switches in accordance with the present disclosure. Communications circuitry 450 includes a DPDT switch using quarter wavelength transmission lines showing an alternative configuration to FIG. 4A. Transceiver 451 includes a Tx pathway and an Rx pathway that are connected to polarized antennas 452 (Pol. 1) and 453 (Pol. 2) through DPDT switch 454. DPDT switch 454 includes 4 quarter wavelength transmission lines 455A, 455B, 455C and 455D. In the Rx pathway (shown as activated), RF signals are received by either Pol. 1 antenna 452 or Pol. 2 antenna 453 based on the position of switches 456, 457, 458 and 459. For the RF signal to be received through Pol. 1 antenna 452, switch 456 is open and switch 458 is open allowing the RF signal to be received through quarter wavelength transmission line 455D.

Standard DPDT switches based on quarter wavelength transmissions lines include signal cross-overs that lead to higher signal loss, lower signal isolation and larger area requirements. In one or more embodiments of the technology described herein, a staggered configuration of receivers, transmitters and the antenna ports of a multi-antenna system are provided that avoid signal cross-overs.

Figure 5:
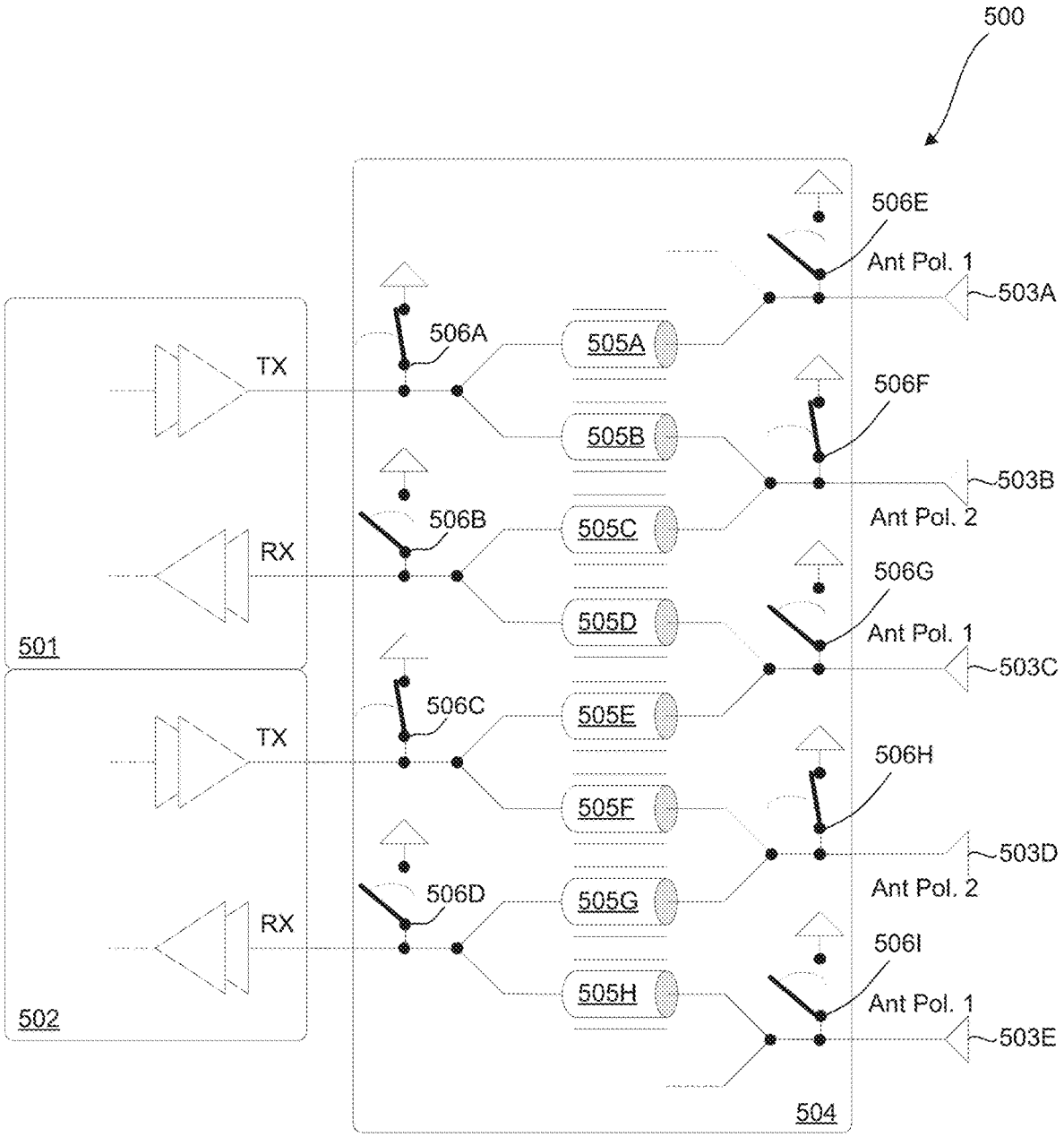
FIG. 5 illustrates an embodiment of a staggered DPDT switch design for a dual-polarized transceiver communications link using quarter wavelength transmission lines in accordance with the present disclosure.

FIG. 5 illustrates an embodiment of a staggered DPDT switch design for a dual-polarized transceiver communications link using quarter wavelength transmission lines in accordance with the present disclosure. Staggered multi-antenna communications system 500 reduces signal routing and cross-overs enabling lower loss and a compact DPDT. In the staggered arrangement, the paired transmitter/receivers 501 and 502 and paired antenna groups (503A/B; 503C/D) are physically offset (not aligned as shown in FIGS. 4A and 4B) from each other. This staggered configuration includes two transceivers 501 and 502, both having a Tx pathway and an Rx pathway. Although described here with two transceivers, staggered configurations including more than two transceivers (e.g., FIG. 7) are within scope of the technology described herein. Transceivers 501 and 502 are connected to polarized antenna 503A (Pol. 1), 503B (Pol. 2), 503C (Pol. 1), 503D (Pol. 2) and 503E (Pol. 1) through DPDT switch 504.

In the Rx pathway (shown as activated), RF signals are received by transceiver 501 by either Pol. 1 antenna 503C or Pol. 2 antenna 503B based on the position the antenna polarization selection switches 506F and 506G. DPDT switch 504 includes Tx/Rx selection switches 506A, 506B, 506C and 506D and antenna polarization selection switches 506E, 506F, 506G, 506H and 5061 for controlling the path of the received RF signal in the communication pathway. For example, in an Rx pathway, the RF signal is received through Pol. 1 antennas 503A, 503C and 503E, and switches 506E, 506G and 5061 are open allowing the RF signal to be received by the receiver pathway. Tx/Rx selection switches 506A through 506D are connected to antenna polarization selection switches 506E through 5061 by quarter wavelength transmission lines 505A, 505B, 505C, 505D, 505E, 505F, 505G and 505H. The staggered configuration as illustrated in FIG. 5 provides for reduced signal cross-over by positioning the transceivers and dual-polarized antennas in a staggered pattern. For example, instead of lining up the receiving pathway and transmission pathway of the transceiver directly in line with the paired dual-polarized antennas, the dual-polarized paired antenna elements are shifted down (or up) relative to the position of the transceiver.

This staggered configuration provides for the Tx/Rx selection switches or the antenna polarization switches to select the nearest (or adjacent) options without having to cross-over other signal paths in a multi-antenna system. For example, in Rx mode as shown in FIG. 5, Tx/Rx selection switch 506B is in the Rx position. To receive an RF signal (e.g., high priority) through a Pol. 1 antenna, the antenna polarization selection switch 506G is in an open position. The staggered configuration provides the Rx pathway with a Pol. 1 polarized antenna that is shared with the Tx pathway of the adjacent transceiver. In an alternative embodiment, the position of the transceivers relative to the dual-polarized antenna elements is shifted to provide the staggered configuration.

Figure 6:
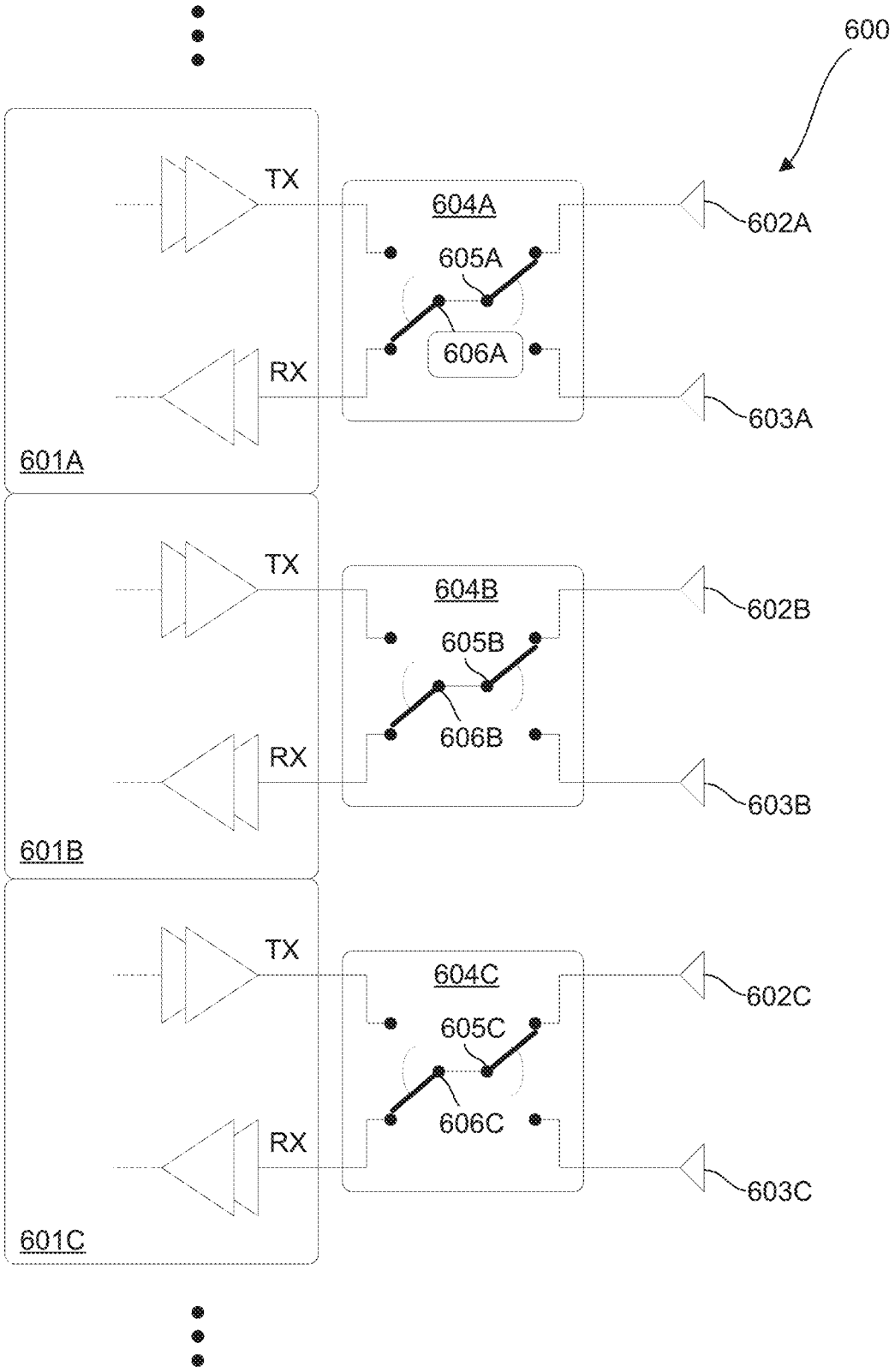
FIG. 6 illustrates an aspect embodiment of a standard DPDT multi-antenna system in accordance with the present disclosure.

FIG. 6 illustrates another aspect embodiment of a standard DPDT multi-antenna system in accordance with the present disclosure. Multi-antenna communications system 600 includes three transceivers (TRXs), each having their own DPDT switch connected to the Rx pathway and the Tx pathway. Transceiver 601A is connected to paired polarized antennas 602A (Pol. 1) and 603A (Pol. 2) through DPDT switch 604A. DPDT switch 604A includes Tx/Rx selection switch 605A and antenna polarization selection switch 606A for controlling the signal pathway. As shown, each transceiver is in direct alignment with each antenna pair and therefore requires its own DPDT.

Transceivers 601B and 601C are connected in a series with transceiver 601A, where transceiver 601B is connected to antennas 602B (Pol. 1) and 603B (Pol. 2) through DPDT switch 604B (including Tx/Rx selection switch 605B and antenna polarization selection switch 606B). Transceiver 601C is connected to antennas 602C (Pol. 1) and 603C (Pol. 2) through DPDT switch 604C (including Tx/Rx selection switch 605C and antenna polarization selection switch 606C). Although shown as a multi-antenna system having three transceivers, multi-antenna systems consisting of four or more transceivers are within scope of the technology described herein.

Figure 7:
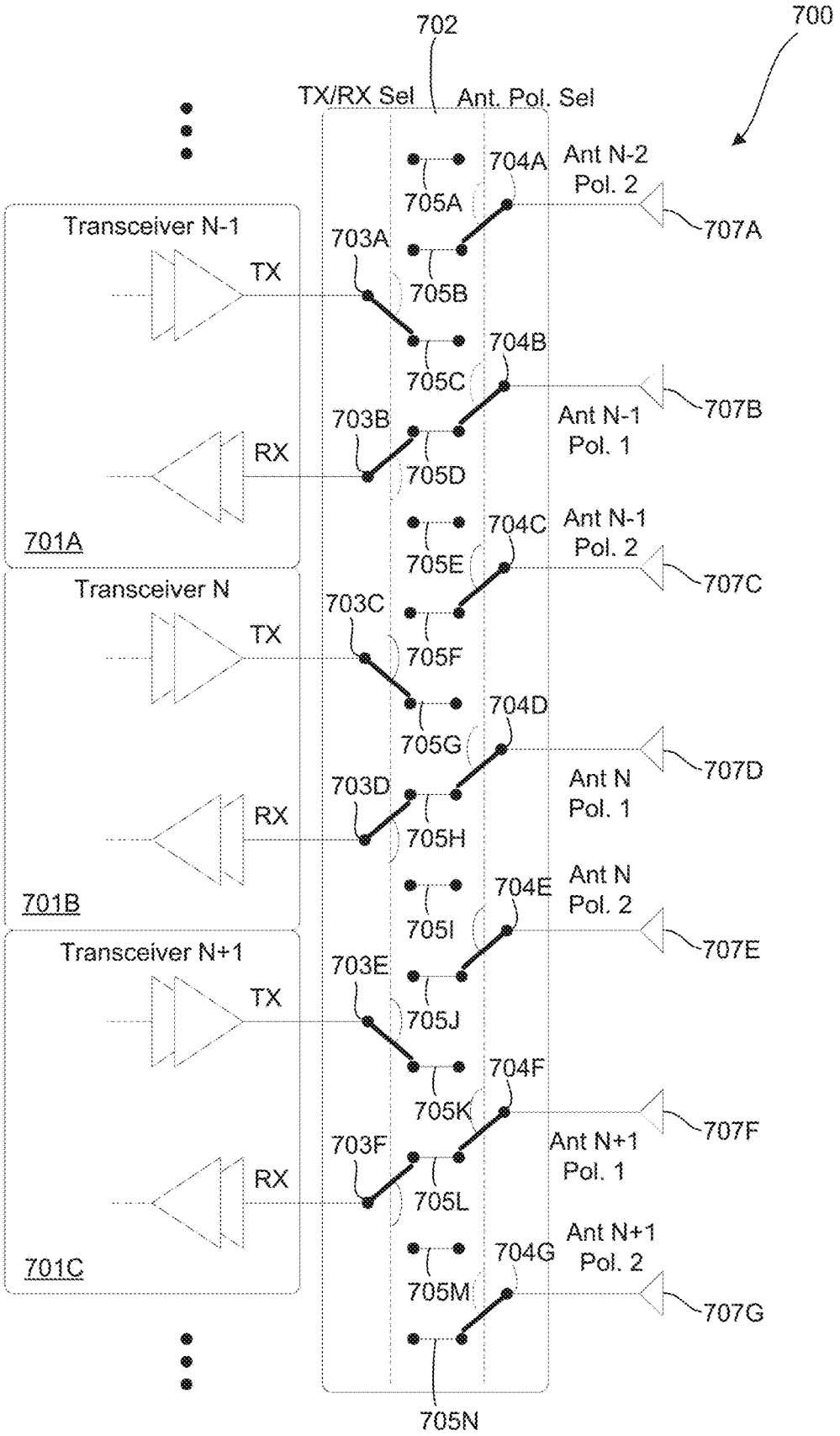
FIG. 7 illustrates an aspect embodiment of a staggered DPDT multi-antenna system in accordance with the present disclosure.

FIG. 7 illustrates an aspect embodiment of a staggered DPDT multi-antenna communications system in accordance with the present disclosure. Staggered DPDT multi-antenna communications system 700 includes three transceivers, each having a DPDT switch connected to the Rx pathway and the Tx pathway. In contrast to the system 600 in FIG. 6, the DPDT switches corresponding to each of the TRXs are connected to the polarized antennas in a staggered configuration. The staggered configuration includes transceivers 701A, 701B and 701C that are connected to the dual-polarized antenna array through DPDT switch 702 so that an antenna is shared between two transceivers. DPDT switch includes Tx/Rx selection switches 703A, 703B, 703C, 703D, 703E and 703F and antenna polarization selection switches 704A, 704B, 704C, 704D, 704E, 704F and 704G for selection a pathway between transceivers 701A through 701C and polarized antennas 707A, 707B, 707C, 707D, 707E, 707F and 707G. DPDT switch 702 provides a connection between Tx/Rx selection switches 703A through 703F and antenna polarization selection switches 704A through 704G using, in one embodiment, spiral inductors 705A, 705B, 705C, 705D, 705E, 705F, 705G, 705H, 705I, 705J, 705K, 705L, 705M and 705N.

In one embodiment, Pol. 1 antennas are used in Rx mode when transceivers 701A, 701B and 701C are connected to antennas 707B (Pol. 1), 707D (Pol. 1) and 707F (Pol. 1) through Tx/Rx selection switches 703B, 703D and 703F and antenna polarization selection 704B, 704D and 704F that connect through spiral inductors 705D, 705H and 705L.

Figure 8:
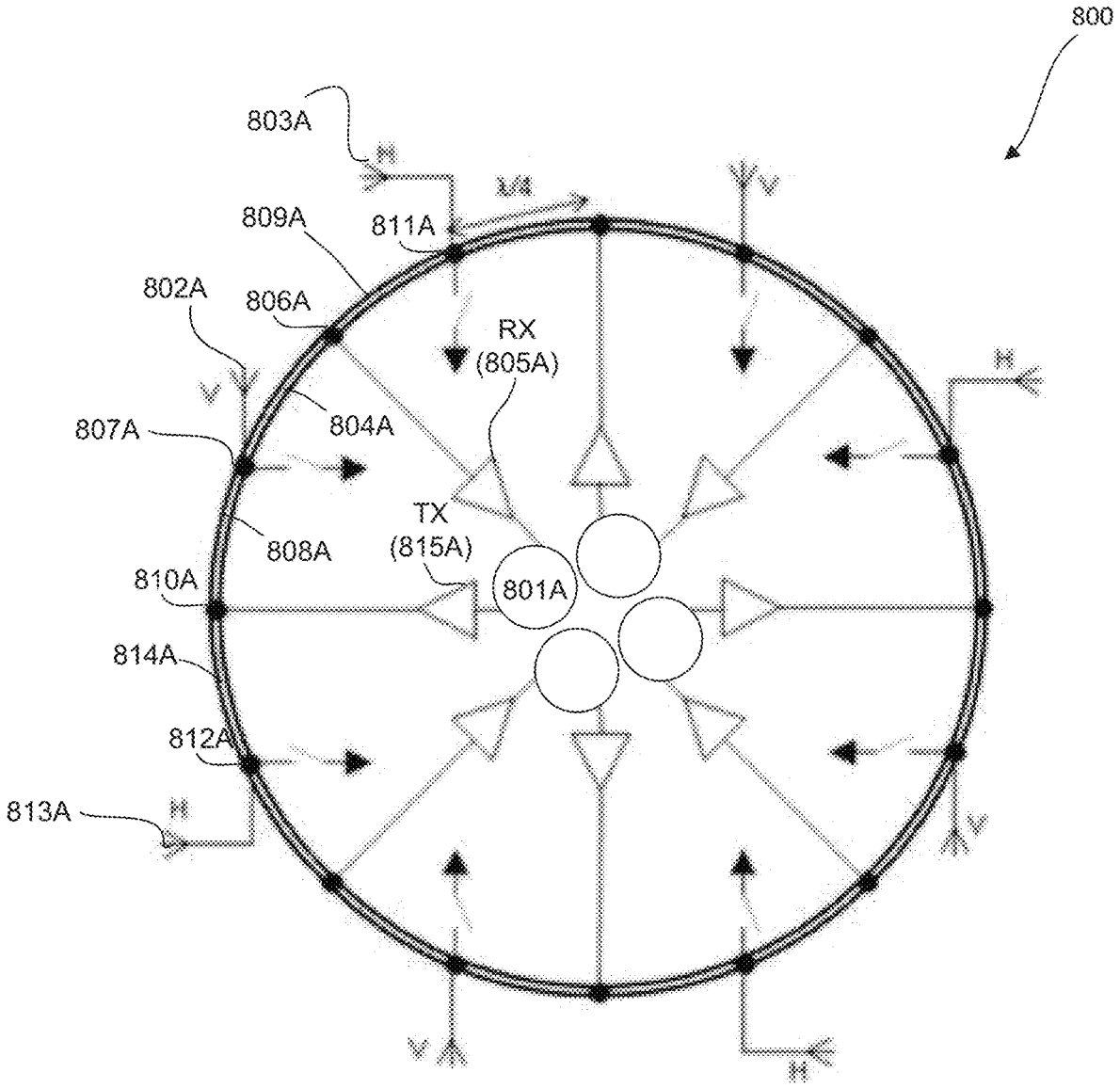
FIG. 8 illustrates an aspect embodiment of a cyclic staggered DPDT multi-antenna system in accordance with the present disclosure.

FIG. 8 illustrates an aspect embodiment of a cyclic staggered DPDT multi-antenna communications system in accordance with the present disclosure. Cyclic staggered DPDT multi-antenna communications system 800 connects the terminal elements (i.e., transceivers, receivers or transmitters at both ends of the multi-antenna system) together cyclically. For example, in Rx mode, transceiver 801A may be connected to vertical polarized antenna 802A (or alternately to horizontal polarized antenna 803A). For vertical polarized antenna 802A, the transceiver 801A is connected to Rx 805A through quarter wavelength transmission line 804A with Tx/Rx selection switch 806A in the Rx position and antenna polarization selection switch 807A in the vertical antenna position. In Tx mode, transceiver 801A may be connected to horizontal polarized antenna 813A connected to Tx 815A through quarter wavelength transmission line 814A with Tx/Rx selection switch 812A in the Tx position. Although the staggered DPDT multi-antenna communications system are shown with horizontal/vertical dual-polarized antennas, it is within scope of the technology described herein to include other dual-polarized antenna systems such as any orthogonally polarized antennas, right-handed/left-handed circular polarization or hybrids thereof. In one embodiment, the staggered DPDT multi-antenna system transmits (or receives) with 45o polarization when the antenna polarization selection switches at both the vertical and horizontal polarization ports remain open.

Quarter wavelength transmission lines 808A, 809A and 814A and Tx/Rx selection switch 810A and antenna polarization selection switch 811A are opened, preventing the operation of the corresponding pathways. Horizontal polarized antenna 813A and antenna polarization selection switch 812A are shared between transceiver 801A and the next transceiver in the cyclic configuration. FIG. 8 is shown as a staggered multi-antenna cyclic configuration having 4 Rx pathways and 4 Tx pathways. Only one staggered transceiver configuration (a receiver and transmitter) is described, however, the Rx and Tx pathways configured in a cyclic manner provide the functions of the subsequent transceivers in a cyclic multi-antenna system.

In an alternative embodiment, the staggered configuration is terminated using one additional Tx or Rx at each terminal end. For example, as shown in FIG. 7, adding an Rx before transceiver 701A and a Tx after transceiver 701C terminates the configuration. In another embodiment, one additional dual-polarized antenna is provided to connect to the Tx/Rx on the edge of the two sides (i.e., top and bottom). In yet another embodiment, the dual-polarized antenna includes one polarized antenna associated with high priority communications and a lower priority antenna associated with lower priority communications.

In other embodiments, termination is provided by not having one antenna available in each polarization for Rx. In an alternative embodiment, termination is provided by removing two antennas in the lower priority Rx polarization. Referring again to FIG. 7, termination is provided by removing the activation of two of the Pol. 2 antennas (i.e., lower priority antenna in this case) for Rx mode.

In one embodiment of the technology described herein, a staggered DPDT multi-antenna communications system includes deep-Nwell N-type metal-oxide-semiconductor (NMOS) switches with positive body bias.

To reduce circuit space requirements in one or more embodiments of the technology described herein, quarter wavelength transmission lines are replaced with spiral inductors. When the staggered DPDT multi-antenna communications system is implemented using spiral inductors, the link performance is improved (e.g., +2.3 dB). Additionally, the output compression of the transmitter is also improved by reduction of the large-signal load provided to the power amplifier (PA).

Figure 9:
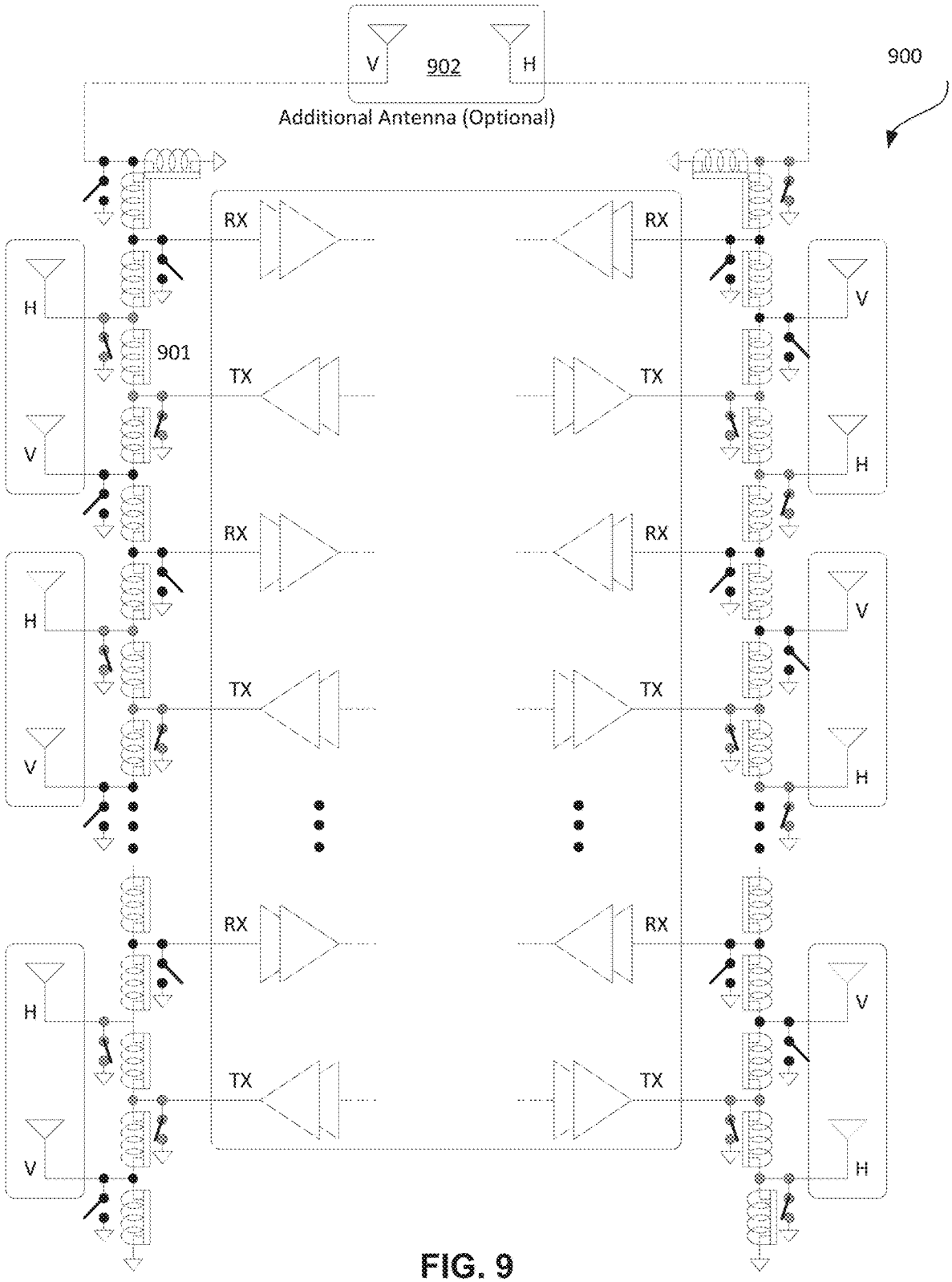
FIG. 9 illustrates an aspect embodiment of a staggered DPDT multi-antenna system implementing spiral inductors in accordance with the present disclosure.

FIG. 9 illustrates an aspect embodiment of a staggered DPDT multi-antenna system implementing spiral inductors in accordance with the present disclosure. Staggered multi-antenna system 900 includes a DPDT switch system using an inductor network connecting Tx/Rx pathways to dual-polarized antenna ports. As previously described, in Tx/Rx modes, staggered multi-antenna system 900 provides for transmitters/receivers associated with staggered dual-polarized antennas through DPDT switches. In this embodiment, the transmission/received communication signals are passed through various spiral inductors 901. In one embodiment, antenna 902 (V) is an optional antenna pair provided as a termination for the multi-antenna system. It is within scope of the technology described herein to select polarized antennas for either Rx or Tx based on signal prioritization or other communications factors.

In one or more embodiments the technology described herein the wireless connection can communicate in accordance with a wireless network protocol such as Wi-Fi, WiHD, NGMS, IEEE 802.11a, ac, b, g, n, or other 802.11 standard protocol, Bluetooth™, LTE, Ultra-Wideband (UWB), WIMAX, or other wireless network protocol, a wireless telephony data/voice protocol such as Global System for Mobile Communications (GSM), General Packet Radio Service (GPRS), Enhanced Data Rates for Global Evolution (EDGE), Personal Communication Services (PCS), or other mobile wireless protocol or other wireless communication protocol, either standard or proprietary. Further, the wireless communication path can include separate transmit and receive paths that use separate carrier frequencies and/or separate frequency channels. Alternatively, a single frequency or frequency channel can be used to bi-directionally communicate data to and from the mobile communications device.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", "processor", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

One or more embodiments of an invention have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The one or more embodiments are used herein to illustrate one or more aspects, one or more features, one or more concepts, and/or one or more examples of the invention. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of one or more of the embodiments. A module includes a processing module, a processor, a functional block, hardware, and/or memory that stores operational instructions for performing one or more functions as may be described herein. Note that, if the module is implemented via hardware, the hardware may operate independently and/or in conjunction with software and/or firmware. As also used herein, a module may contain one or more sub-modules, each of which may be one or more modules.

While particular combinations of various functions and features of the one or more embodiments have been expressly described herein, other combinations of these features and functions are likewise possible. The present disclosure of an invention is not limited by the particular examples disclosed herein and expressly incorporates these other combinations.

What is claimed is:

1. A cyclic staggered multi-antenna communications system comprising:

a circular arrangement of a plurality of antennas;

a plurality of transceivers centrally located within the circular arrangement and operatively connected to one or more of the plurality of antennas for processing communication signals, each transceiver including a transmitter and a receiver; and wherein the plurality of antennas includes a plurality of dual-polarized antenna pairs each dual-polarized antenna pair including at least a first antenna with a first polarization and a second antenna with a second polarization, the first antenna and second antenna transmitting and receiving the communications signals;

a first group of switches; and a second group of switches, wherein the transmitter is connectable, via the first group of switches, one antenna of a first dual-polarized antenna pair, wherein the receiver is connectable, via the second group of switches, to another antenna of a second dual-polarized antenna pair, and wherein the first dual-polarized antenna pair and the second dual-polarized antenna pair share a same physical one of the first antenna with the first polarization but include different physical ones of the second antenna with the second polarization.

2. The cyclic staggered multi-antenna communications system according to claim 1, wherein a transceiver of the plurality of transceivers is connected to the at least one antenna through a quarter wavelength transmission line with a transmitting/receiving selection switch and an antenna polarization selection switch.

3. The cyclic staggered multi-antenna communications system according to claim 2, wherein the communications system transmits or receives with 45° polarization when the antenna polarization selection switch remains open at both a vertical polarization port and a horizontal polarization port, wherein each port is located at spaced antenna connection points along the circular arrangement.

4. The cyclic staggered multi-antenna communications system according to claim 1, wherein polarization of the first antenna with the first polarization and the second antenna with the second polarization is one or more of: horizontal and vertical polarization, right-handed and left-handed circular polarization or combinations thereof.

5. The cyclic staggered multi-antenna communications system according to claim 1, wherein the first group of switches and the second group of switches are connected with at least one of: transmission lines or spiral inductors.

6. The cyclic staggered multi-antenna communications system according to claim 1, wherein the first group of switches and the second group of switches comprise deep-Nwell NMOS switches with positive body bias.

7. The cyclic staggered multi-antenna communications system according to claim 1, wherein the polarized paired antennas include one polarized antenna utilized for high priority communications and a lower priority antenna utilized for lower priority communications.

8. The cyclic staggered multi-antenna communications system according to claim 1, further comprising at least one of: an additional unpaired transmitter, an additional unpaired receiver, a terminal polarized antenna or one or more lower priority polarized antennas.

9. A cyclic staggered multi-antenna communications system comprising:

a circular arrangement of a plurality of antennas, wherein the circular arrangement of the plurality of antennas is terminated using one additional transmitter or receiver at a terminal end;

a plurality of transceivers centrally located within the circular arrangement and operatively connected to one or more of the plurality of antennas for processing communication signals; and wherein the plurality of antennas includes a plurality of paired polarized antennas associated with each of the plurality of transceivers, the plurality of paired polarized antennas including at least a first antenna with a first polarization and a second antenna with a second polarization, the first antenna and second antenna transmitting and receiving the communications signals; and a first group of switches selectively connecting a transmitter or a receiver, of the plurality of transceivers, to at least one antenna from each of the plurality of paired polarized; and a second group of switches selectively connecting a transmitter or a receiver, of the plurality of transceivers, to at least one antenna from a physically adjacent pair of the plurality of paired polarized antennas.

10. A cyclic multi-antenna communication system comprising:

a plurality of paired transmitters and receivers for processing communication signals;

a circularly arranged plurality of dual-polarized antenna pairs, each dual-dual-polarized antenna pair including at least a first antenna with a first polarization and a second antenna with a second polarization, the first antenna and second antenna transmitting and receiving the communications signals;

a first group of switches; and a second group of switches, wherein a first paired transmitter is connectable, via a first group of switches, one antenna of a first dual-polarized antenna pair, wherein a corresponding paired receiver is connectable, via a second group of switches, to another antenna of a second dual-polarized antenna pair, and wherein the first dual-polarized antenna pair and the second dual-polarized antenna pair share a same physical one of the first antenna with the first polarization but include different physical ones of the second antenna with the second polarization.

11. The cyclic multi-antenna communication system according to claim 10, wherein polarization of the first antenna with the first polarization and the second antenna with the second polarization is one or more of: horizontal and vertical polarization, right-handed and left-handed circular polarization or combinations thereof.

12. The cyclic multi-antenna communication system according to claim 10, wherein the first group of switches and the second group of switches are connected with at least one of: transmission lines or spiral inductors.

13. The cyclic multi-antenna communication system according to claim 10, wherein the first group of switches and the second group of switches comprise deep-Nwell NMOS switches with positive body bias.

14. The cyclic multi-antenna communication system according to claim 10, wherein the cyclic multi-antenna communication system is a phased-array.

15. The cyclic multi-antenna communication system according to claim 10, wherein the cyclic multi-antenna communication system is operable in a multiple-in, multiple out communications network.

16. The cyclic multi-antenna communication system according to claim 10, wherein the first antenna with the first polarization is for higher priority communications and the second antenna with the second polarization for lower priority communications.

17. The cyclic multi-antenna communication system according to claim 10, further comprising at least one of: an additional unpaired transmitter, an additional unpaired receiver, a terminal polarized antenna in a receiver pathway, more than one terminal, or a lower priority polarized antenna in the receiver pathway.

18. The cyclic multi-antenna communication system according to claim 10, wherein the plurality of paired transmitters and receivers are arranged in an alternating order.

19. The cyclic communications device of claim 10, wherein the pair of polarized antennas include polarizations of one or more of: vertical, horizontal, circular and dual.

20. The cyclic communications device of claim 10, wherein the pair of polarized antennas comprise dual polarized antennas and the first polarization and the second polarization include 45° polarization when antenna polarization selection switches are open.

* * * * *